US007205499B2

(12) United States Patent
Masnada et al.

(10) Patent No.: US 7,205,499 B2
(45) Date of Patent: Apr. 17, 2007

(54) DEVICE FOR FIXING A SHIELD IN AN ELECTRIC SWITCH, IN PARTICULAR A VACUUM SWITCH

(75) Inventors: Roland Masnada, Eybens (FR); Olivier Cardoletti, Fontaine (FR); Albin Henon, Claix (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 11/066,746

(22) Filed: Feb. 28, 2005

(65) Prior Publication Data

US 2005/0194359 A1 Sep. 8, 2005

(30) Foreign Application Priority Data

Mar. 2, 2004 (FR) ..... 04 02152

(51) Int. Cl.
*H01H 33/66* (2006.01)

(52) U.S. Cl. ..... 218/136; 218/134

(58) Field of Classification Search ..... 218/10, 218/17, 48–77, 118–139, 155
See application file for complete search history.

(56) References Cited

U.S. PATENT DOCUMENTS

| | | | | |
|---|---|---|---|---|
| 3,048,681 A | | 8/1962 | Polinko, Jr. | 200/144 |
| 3,189,715 A | | 6/1965 | Jennings | 200/144 |
| 4,002,867 A | * | 1/1977 | Cherry | 218/134 |
| 4,127,755 A | | 11/1978 | Bialkowski | 200/144 |
| 4,665,287 A | * | 5/1987 | Sofianek et al. | 218/136 |
| 4,733,456 A | * | 3/1988 | Sofianek et al. | 29/622 |
| 4,757,166 A | * | 7/1988 | Slade | 218/134 |
| 5,077,883 A | | 1/1992 | Schellekens et al. | |
| 5,444,201 A | * | 8/1995 | Schulman et al. | 218/118 |
| 5,929,411 A | * | 7/1999 | Schulman | 218/136 |
| 6,417,473 B1 | | 7/2002 | Mayo et al. | 218/136 |
| 6,657,149 B1 | * | 12/2003 | Fieberg et al. | 218/136 |
| 6,930,270 B2 | * | 8/2005 | Fieberg et al. | 218/134 |

FOREIGN PATENT DOCUMENTS

| | | |
|---|---|---|
| EP | 0406944 | 1/1991 |
| EP | 1172834 | 1/2002 |

(Continued)

*Primary Examiner*—Elvin Enad
*Assistant Examiner*—M. Fishman
(74) *Attorney, Agent, or Firm*—Steptoe & Johnson LLP

(57) ABSTRACT

The present invention relates to a device for fixing a shield in a switch, said switch being housed in an enclosure comprising a cylindrical part closed by two end parts forming covers, said cylindrical part being connected at its two free ends respectively to the two end covers and comprising one or more cylindrical insulators mechanically connected to one another, at least one shield for protection of the insulators being supported by a cylindrical ring fixed between two of the above-mentioned mechanically connected parts of the enclosure, at the level of the mechanical connection between these two parts. This device is characterized in that the above-mentioned shield comprises on its external surface at least one localized material spinning point, arranged in such a way as to form at least one bearing point of the shield on the ring, so as to achieve stopping of the shield in translation in a direction parallel to the axis of the enclosure.

8 Claims, 4 Drawing Sheets

FOREIGN PATENT DOCUMENTS

| | | |
|---|---|---|
| FR | 2819093 | 7/2002 |
| GB | 1101674 | 1/1968 |
| GB | 1596471 | 8/1981 |
| JP | 2000-294089 | 10/2000 |
| WO | WO 200249056 A1 * | 6/2002 |

* cited by examiner

DEVICE FOR FIXING A SHIELD IN AN ELECTRIC SWITCH, IN PARTICULAR A VACUUM SWITCH

BACKGROUND OF THE INVENTION

The present invention relates to a device for fixing a shield in a switch, said switch comprising an enclosure comprising a cylindrical part closed by two end parts forming covers, said enclosure housing two contacts extending axially inside the enclosure at least one of which contacts, called the movable contact, is connected to an operating mechanism and is mounted sliding between a closed position of the contacts and a position wherein the contacts are separated and cause interruption of an electric circuit, said cylindrical part being mechanically connected via its two free ends respectively to the two end covers and comprising one or more parts forming cylindrical insulators mechanically and axially connected to one another, and at least one protective shield being supported by a cylindrical ring fixed between two of the above-mentioned mechanically connected parts of the enclosure, at the level of the mechanical connection between these two parts.

The main purpose of these metal shields situated inside the ceramic insulator(s) is to protect the ceramic part(s) from condensation of metal vapors originating from the arcing phase produced between the contacts during breaking of the electric current.

STATE OF THE ART

One of the possibilities for fitting this shield consists in connecting the latter mechanically and electrically to the metal cover that also supports the stationary contact. Another usual assembly consists in insulating the shield electrically from the two covers and in this way in placing it at floating potential. This enables the dielectric strength of the cartridge to be substantially improved in comparison with the use of a shield at fixed potential.

When the cartridge only comprises a single ceramic insulator, the shield at floating potential is connected to the insulator either directly or by means of intermediate parts. The documents U.S. Pat. No. 5,077,883 and EP 0,406,944 describe a shield connected directly to the insulator by deformation of the shield around a generally asymmetric protuberance of the insulator. The document EP 1,172,834 describes a shield connected to the insulator by an arrangement of intermediate parts, one of them being housed in a groove of the insulator provided for this purpose. This fixing mode substantially increases the complexity of the shape and the manufacturing cost of the insulator. Moreover, the shield thus fitted does not offer any electrical connection point with the outside enabling the switch cartridge to be voltage controlled.

For all these reasons, it appeared of interest to weld the metal shield to a circular ring interposed and welded between two less expensive ceramic parts of simple cylindrical shape. Connection of this circular ring with the shield is achieved either by means of intermediate parts, as described in the document EP 1,172,834, or directly by pressing the shield onto the ring, as described in the document FR 2,819,093, the latter two parts having complementary revolving shapes ensuring both coaxial guiding of the shield and stopping of the latter in translation. In the above-mentioned first fixing mode, it may be necessary to perform a specific welding cycle of the intermediate parts onto the shield. In the second case, the metal shield has to comprise a revolving shoulder achieved by machining or embossing.

OBJECT OF THE INVENTION

The present invention proposes a device for fixing a shield in a vacuum switch, of simple design, that does not require any intermediate parts.

For this purpose, it is an object of the present invention to provide a device for fixing a shield in a switch of the kind previously referred to, this device being characterized in that the above-mentioned shield comprises on its external surface at least one localized material spinning point, arranged in such a way as to form at least one bearing point for the shield on the ring, so as to achieve stopping of the shield in translation in a direction parallel to the axis of the enclosure.

According to a particular feature of the invention, the shield comprises three equidistant localized spinning points.

According to another feature, a ring is fixed between one of the free ends of the above-mentioned cylindrical part and the cover whereto this end if affixed, said ring supporting a shield called the upper or lower shield.

According to another feature, the cartridge comprising two tubular insulators placed end to end, a ring is fixed between the two insulators and supports a shield called the central shield, fixed to the floating potential between the two insulators.

According to another feature, the above-mentioned ring presents an L-shaped cross-section.

According to another feature, said ring is shaped and dimensioned in such a way as to prevent movement of the shield in a direction perpendicular to the axis of the switch.

According to another feature, the shield thus positioned is welded onto the circular ring by means of a welding seam situated between the two parts.

It is a further object of the present invention to provide a switch comprising the features set out above either alone or in combination.

BRIEF DESCRIPTION OF THE DRAWINGS

But other advantages and features of the invention will become more clearly apparent from the following detailed description which refers to the accompanying drawings given for example purposes only and in which.

DETAILED DESCRIPTION OF AN EMBODIMENT

Figure 1:
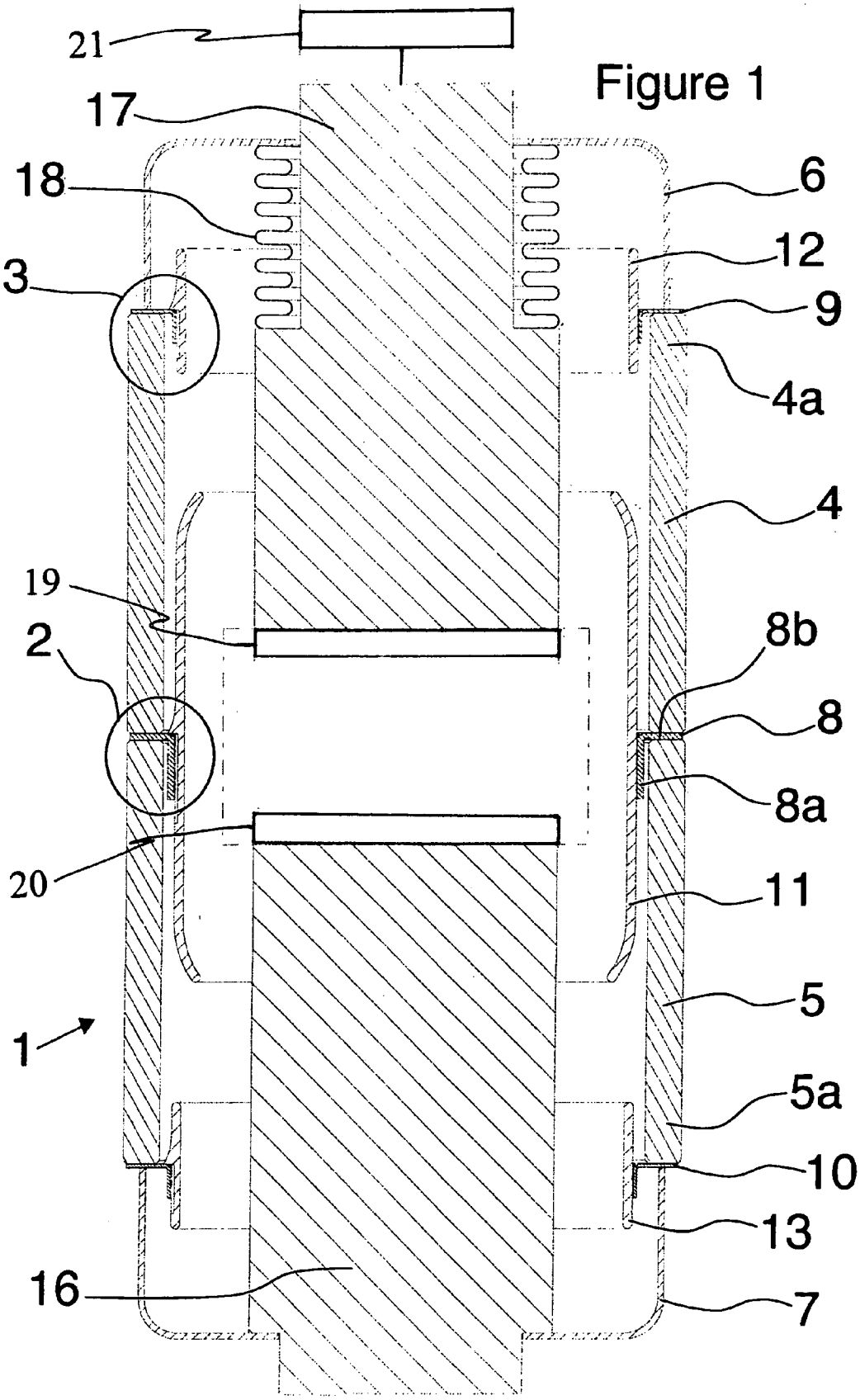
FIG. 1 is a longitudinal sectional view of a vacuum switch comprising a device for fixing a shield according to the invention.
Figure 2:
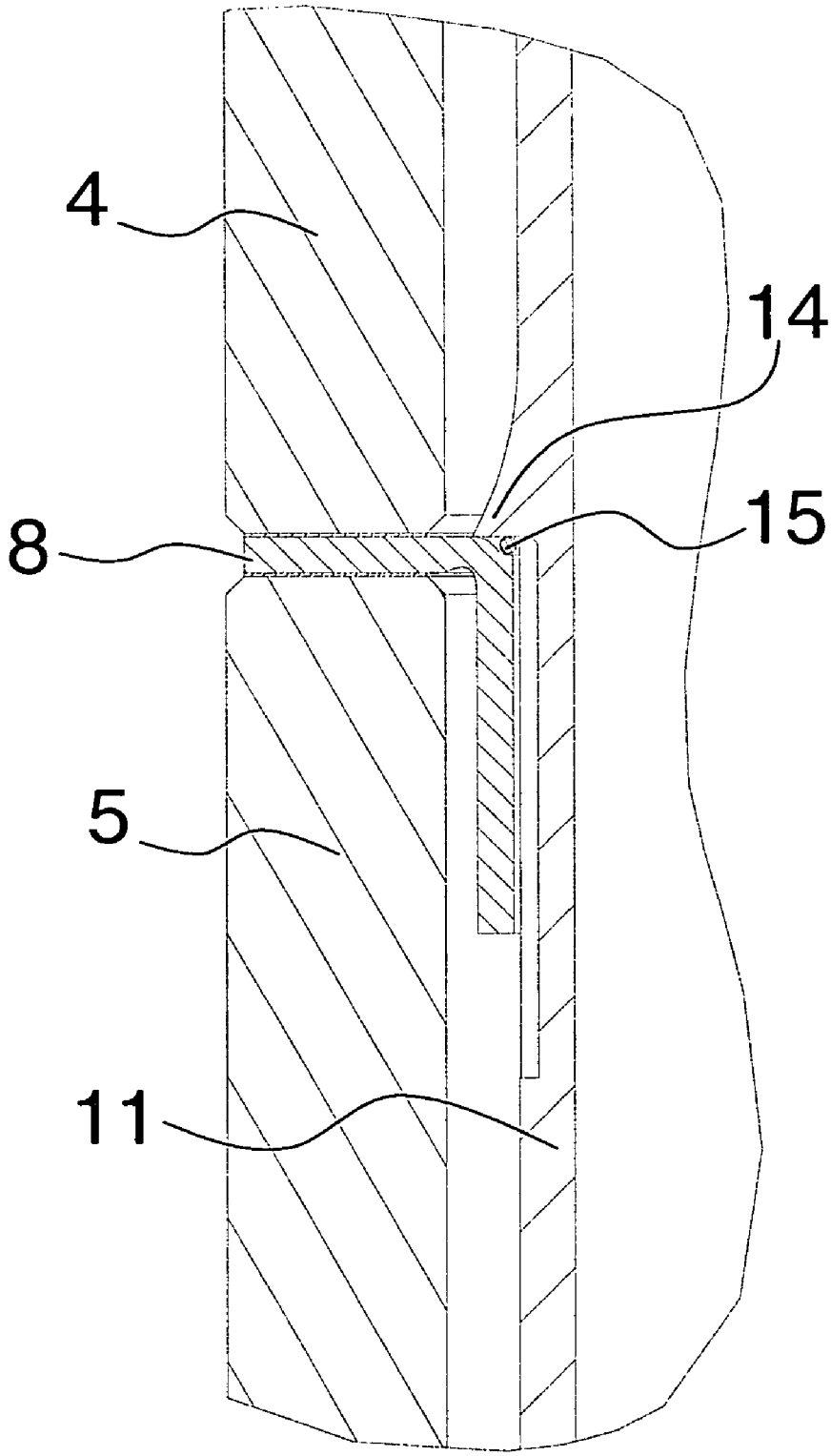
FIG. 2 is an enlarged detailed view of FIG. 1.
Figure 3:
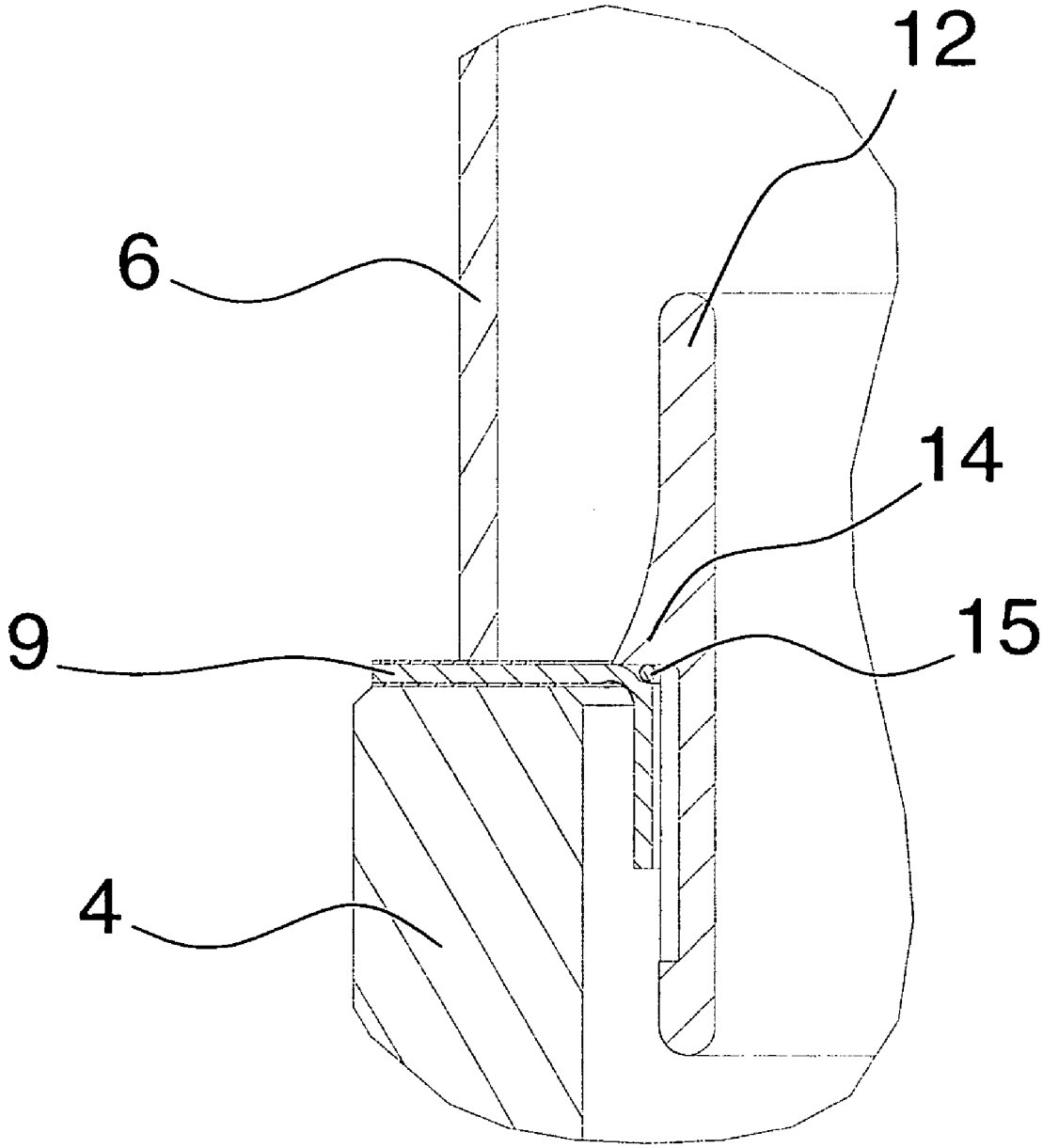
FIG. 3 is another enlarged detailed view of FIG. 1, illustrating another implementation of the device for fixing the shield in the vacuum switch.
Figure 4:
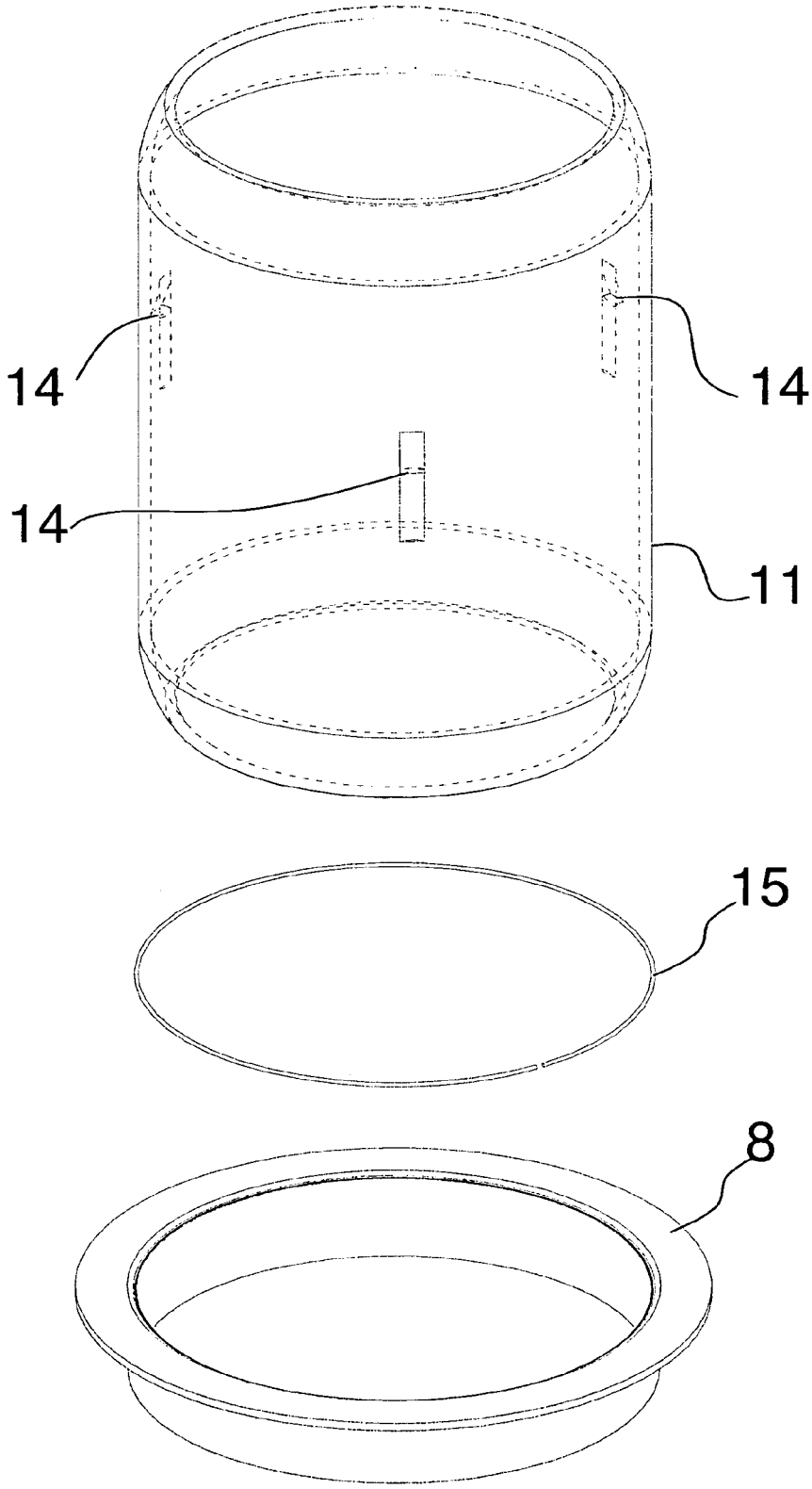
FIG. 4 is an exploded view representing the shield, a circular ring and a seal according to the invention.

In FIG. 1, a vacuum cartridge 1 can be seen designed to be integrated in a medium voltage electric circuit breaker or switch to perform breaking of an electric circuit in the event of a fault or on a deliberate opening command of the electric circuit.

This cartridge 1 comprises an enclosure comprising a cylindrical part 4,5 closed by two end-plates 6,7. This cylindrical part is formed by two tubular ceramic insulators 4,5 and the two end-plates by two metal covers 6,7. This enclosure houses two contacts (not shown), one whereof, the stationary contact, being fixedly secured to one 7 of the covers 6,7 and connected to said cover by an electrode 16, whereas the other, movable, contact is mounted on an electrode 17 able to move in the axis of the cartridge 1 and passing through the other metal cover 6 to be connected to an operating mechanism (not shown). The movable contact is mounted sliding axially inside the enclosure between a closed position of the contacts corresponding to a rest position of the circuit breaker and a position wherein the contacts are separated and cause breaking of the electric circuit. The tightness at the level of the bushing is achieved by means of a metal bellows 18 connecting the mobile electrode 17 to the cover 6.

This switch also comprises a first metal shield 11 the main purpose whereof is to protect the insulator(s) 4,5 from condensation of metal vapors originating from the arcing phase produced between the contacts during breaking of the electric current.

The apparatus also comprises a second shield 12 situated at the level of the junction between one 6 of the covers 6,7 and one 4 of the insulators 4,5, and a third shield 13 situated at the level of the junction between the second cover 7 and the other insulator 5.

Each of these shields 11,12,13 is supported by a circular ring 8,9,10 of inverted L-shaped cross-section and comprising a part 8*a* extending in a direction parallel to the axis of the cartridge and a part 8*b* extending in a direction perpendicular to this axis. As far as the first shield 11 is concerned, the latter part 8*b* of the ring 8 is fixed between the two insulators 4,5 by welding.

As far as the second shield 12 is concerned, this part 8*b* is fixed between one 6 of the covers 6,7 and the corresponding end 4*a* of the insulator 4. As far as the third shield 13 is concerned, this part 8*b* is fixed between one 7 of the covers 6,7 and the corresponding end 5*a* of the insulator 5.

These insulator protective shields 11,12,13 comprise on their external surface three localized material spinning points 14 designed to press on the corresponding circular ring 8,9,10 thus ensuring stopping of the shields 11,12,13 in translation inside the cartridge 1. The shape and dimensions of the circular ring 8,9,10 are such that the shields cannot move in the other directions, i.e. perpendicularly to the axis of the cartridge. The shields thus positioned are fixed to the circular ring 8,9,10 by vacuum welding by means of a welding seam 15 situated between the two parts.

A simplified device for fixing insulator protective shields has thus been achieved by means of the invention, without any intermediate parts between the shield and the circular ring fixed between the insulators or the insulator and one of the covers of a vacuum switch cartridge. The means for stopping in translation is achieved in the form of at least one bearing point achieved at low industrial cost by localized material spinning on the external surface of the shield. This point can thus press on a copper ring, which, due to its shaping, prevents the other degrees of freedom of the shield inside the cartridge.

Localized material spinning advantageously replaces revolving shaping of the whole of the shield from the technical, technological and ecological points of view, to perform the same function. Moreover, the internal surface of the shield is not affected by the spinning method, thus preserving the dielectric surface qualities of the part, which is a necessary condition for guaranteeing the electrical performances of a vacuum switch cartridge.

Furthermore, as the connection between the shield and ring does not require any intermediate parts, it can be achieved at the same time as closing of the cartridge is performed, without an additional welding cycle.

The present invention can be used for fixing insulator protective shields at different points of the cartridge. It enables both the shield to be fixed at floating potential between two insulators and shields to be fixed between the insulator and one of the covers forming the enclosure of the cartridge.

The number of spinning points is a minimum of one to block the translation movement of the shield. Depending on the adjustment between the shield and the circular ring, it may be useful to increase the number of spinning points. According to the embodiment described, three localized spinning points are provided, situated 120° from one another, on the circumference of the insulator protective shield.

Naturally the invention is not limited to the embodiments described and illustrated which have been given for example purposes only.

On the contrary, the invention extends to encompass all the technical equivalents of the means described as well as combinations thereof if the latter are achieved within the spirit of the invention.

The invention claimed is:

1. A device for fixing a shield in a switch comprising:

an enclosure comprising a cylindrical part closed by at least one end cover, said enclosure housing two contacts extending axially inside the enclosure, at least one of which is a movable contact, connected to an operating mechanism for sliding between a closed position of the contacts and a position wherein the contacts are separated interrupting an electric circuit, said cylindrical part being mechanically connected via at least one free end to the at least one end cover and comprising at least two cylindrical insulators axially connected to one another, and at least one first protective shield supported by a first cylindrical ring fixed between the at least one free end of the cylindrical part and the at least one end cover at the point where the at least one free end and the at least one end cover are mechanically connected, said cylindrical part further comprising at least one second protective shield supported by a second cylindrical ring fixed between the at least two cylindrical insulators at the point where the cylindrical insulators are mechanically connected, wherein the said first and second shields comprise on each of their external surfaces at least one locally spun stop tab which stop tab does not modify the internal surface of the shield, said stop tab comprising one bearing point for the shield on the ring, for stopping the shield from moving in a direction parallel to the translational axis of the contacts in the enclosure.

2. The device according to claim 1, wherein said first or second shield comprises three equidistant stop tabs.

3. The device according to claim 1, wherein said first cylindrical ring is fixed between the at least one free end of the cylindrical part and the at least one end cover, said first cylindrical ring supporting said first shield.

4. The device according to claim 1, wherein the at least two cylindrical insulators are placed end to end, wherein the second cylindrical ring is fixed between the at least two insulators and supports the second shield fixed to a floating potential between the at least two insulators.

5. The device according to claim 1, wherein the at least one first or second cylindrical ring comprises an L-shaped cross-section.

6. The device according to claim 5, wherein said first or second ring is shaped for preventing movement of the at least one first or second shield in a direction perpendicular to the translational axis of the contacts in the switch.

7. The device according to claim 1, wherein the at least one first or second shield is welded onto the cylindrical ring with a welding seam situated between the at least one first or second ring and the shield.

8. A vacuum switch comprising at least one device according to claim 1.

* * * * *